US006707923B2

(12) United States Patent
Pronk

(10) Patent No.: US 6,707,923 B2
(45) Date of Patent: Mar. 16, 2004

(54) FOLDABLE HOOK FOR HEADSET

(75) Inventor: Peter Pronk, Amsterdam (NL)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/988,693

(22) Filed: Nov. 20, 2001

(65) Prior Publication Data

US 2003/0002704 A1 Jan. 2, 2003

Related U.S. Application Data

(60) Provisional application No. 60/302,491, filed on Jul. 2, 2001.

(51) Int. Cl.[7] ..... H04R 25/00
(52) U.S. Cl. ..... 381/374; 381/381
(58) Field of Search ..... 381/370, 374, 381/375, 376, 379, 381; 379/430, 433; 455/90

(56) References Cited

U.S. PATENT DOCUMENTS 5,177,784 A * 1/1993 Hu et al. ..... 379/430
6,055,312 A * 4/2000 Pralus et al.
6,101,260 A * 8/2000 Jensen et al.

FOREIGN PATENT DOCUMENTS

| | | |
|---|---|---|
| DE | 20104916 | 6/2001 |
| JP | 56069988 | 6/1981 |
| JP | 60105326 | 6/1985 |

OTHER PUBLICATIONS

Zanti, P., Standard Search Report prepared by European Patent Office completed Jul. 18, 2003 (2 pgs.).

* cited by examiner

*Primary Examiner*—Sinh Tran
(74) *Attorney, Agent, or Firm*—Jenkens & Gilchrist, P.C.

(57) ABSTRACT

An apparatus for affixing a headset to the ear of a user includes a first member having a first end and a second end. The first end is rotatably connected to the headset. A second member also includes a first end and a second end, and the first end of the second member rotatably connects to the second end of the first member. The second member contacts at least a portion of the ear of the user assisting in affixing the headset to the ear of the user.

18 Claims, 2 Drawing Sheets

FOLDABLE HOOK FOR HEADSET

RELATED APPLICATION(S)

This application claims priority from and incorporates herein by reference the entire disclosure of U.S. Provisional Application Ser. No. 60/302,491 filed Jul. 2, 2001.

TECHNICAL FIELD

The present invention relates to headsets worn on the ear, and more particularly, to a foldable hook for connecting a headset to the ear of a user.

BACKGROUND OF THE INVENTION

Headsets enable a user to carry out two-way communications while still leaving a user's hands free to perform other functions. Headsets are used with wireline telephones, wireless telephones and a variety of other communication devices wherein two-way communications occur between a user and another party or a voice actuated device.

One type of headset useful with portable communication devices are headsets that are attached to only the ear of a user, using some type of a hook or attaching component. The hook affixes the headset to the ear or head of the user and positions a speaker near the user's ear and a microphone near a user's mouth to enable hands free communication. These types of headsets are very popular with, for example, mobile telephones wherein a user may continue to perform other functions such as driving or working while still communicating via their mobile telephone. The problem with these types of headsets arises when they are not in use, i.e., placed upon the ear or head of a user. The combination of the main body of the headset and the hook for attaching it to a user produces a large product which is not easily stored. A headset having a hook sticking out from the main housing does not easily fit within a pocket or purse of a user. Additionally, the hook extending from the body of the headset makes it difficult to remove the headset from the storage area since the hook may snag or catch upon other items. Thus, there is needed some manner of providing a apparatus to provide a compact and more efficient storage for the headset when not in use.

SUMMARY OF THE INVENTION

The present invention overcomes the foregoing and other problems with a foldable hook for affixing a headset to an ear or a user. The foldable hook consists of a first member having first and second ends. The first end of the first member rotatably connects to a headset. A second member also has first and second ends. The first end is rotatably connected to the second end of the first member and contacts at least a portion of the ear of the user. An integral third member can be used for rotating the second member about its connection with the first member and for rotating the first member about its connection with the housing of the headset.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION

Figure 1:
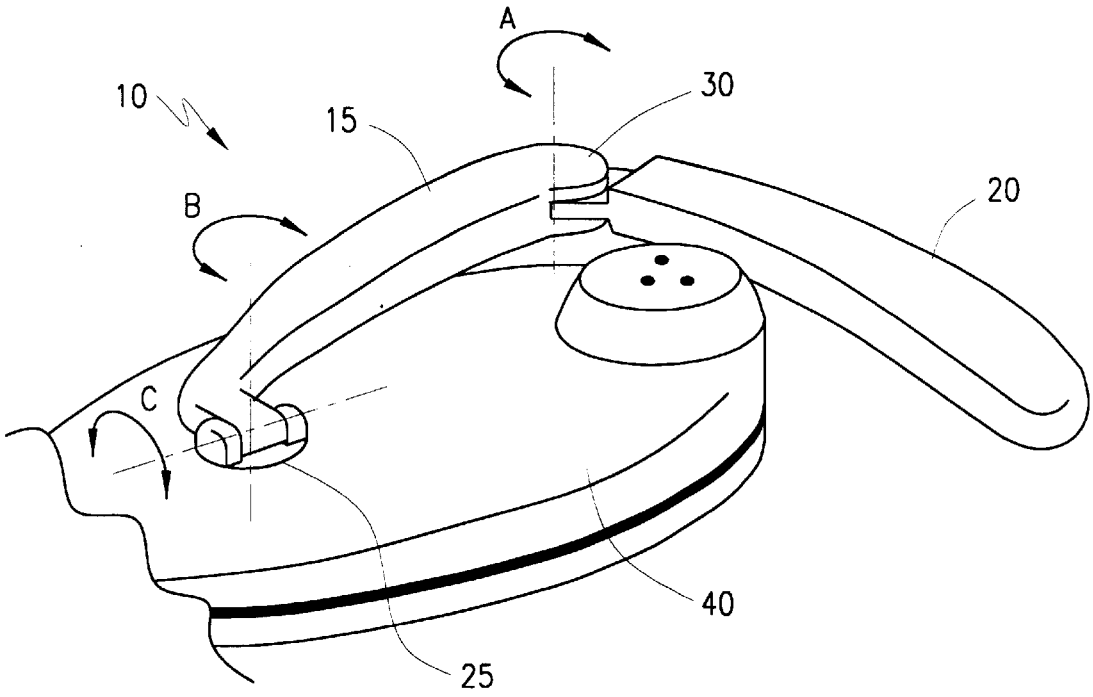
FIG. 1 illustrates the foldable headset hook of the present invention in an open position.

Referring now to the drawings, and more particularly to FIG. 1, there is illustrated the foldable hook of the present invention. The main portion of the foldable hook 10 consists of a first member 15 and a second member 20. The first member 15 interconnects the foldable hook 10 to the housing 40 of a headset via a rotatable joint 25. The rotatable joint 25 enables the first member of the foldable hook 10 to rotate about the axis B and more compactly wrap the foldable hook 10 about a housing of the headset as will be more fully described in a moment. The rotatable joint 25 interconnecting the foldable hook 10 to a housing of a headset includes a spring or other biasing unit for biasing the foldable hook 10 to a closed (i.e., wrapped around the headset) position. The rotatable joint 25 also enables rotation of member 15 about axis C to allow the headset to be worn on the left and right ears. Alternatively, member 15 may be reattachable to joint 25 to enable left/right wearing.

A second member 20 of the foldable hook 10 is connected to the first member 15 via a second rotatable joint 30. The second rotatable joint 30 enables the second member 20 to rotate about the axis A. As with the first joint 25, the second joint 30 includes a spring (or other biasing unit) biasing the second member 20 to a closed position. The second member 20 has a generally arcuate shape enabling the second member 20 to more effectively wrap around and engage an ear of a user. The second member 20 may further include some type of padded covering to enable the second member 20 to more effectively and comfortably engage an ear of a user.

Figure 2:
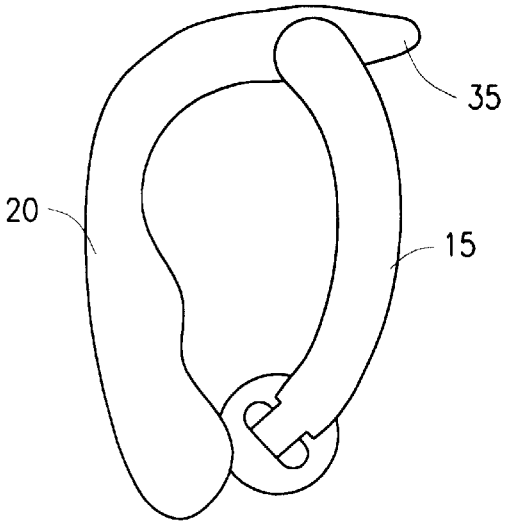
FIG. 2 illustrates the foldable headset hook in a closed position.
Figure 3:
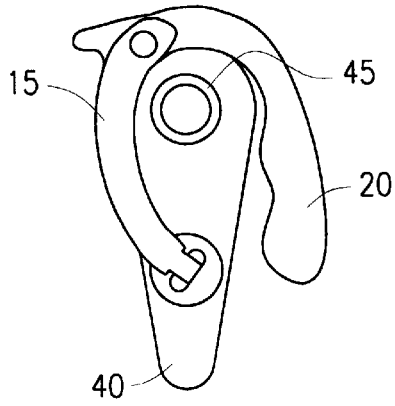
FIG. 3 illustrates the foldable headset hook in a closed position around a headset housing.

Referring now to FIGS. 2 and 3, there is illustrated the foldable hook 10 in a closed position both disconnected from (FIG. 2) and connected to (FIG. 3) the housing 40 of a headset. As can be seen from each figure, the first member 15 is rotated toward the housing 40 of the headset by the biasing forces of joint 25. Likewise, the second member 20 is rotated toward the opposite side of the housing 40 by the biasing forces of the spring within joint 30. In this way, the first 15 and second 20 members of the foldable spring 10 wrap around the earpiece 45 of the housing 40 providing a much more compact package than if the hook remained in an extended position.

An actuator arm 35 integrally connected with the second member 20 may extend from the second member 20 or form an integral portion thereof. By manipulating the actuator arm 35, the second member 20 may be rotated about its connection with the first member 15 to enable the foldable hook 10 to move from a closed to an open position in order to more easily engage the ear of the user. Additionally, the actuator arm 35 may be used to rotate the first member 15 about its rotatable joint 25 with the housing of the headset in order to better position the foldable hook 10 for engaging the ear of a user. The actuator arm 35 may include a number of ridges 40 defined therein to provide the user's finger with a better grip of the actuator arm 35.

Figure 4:
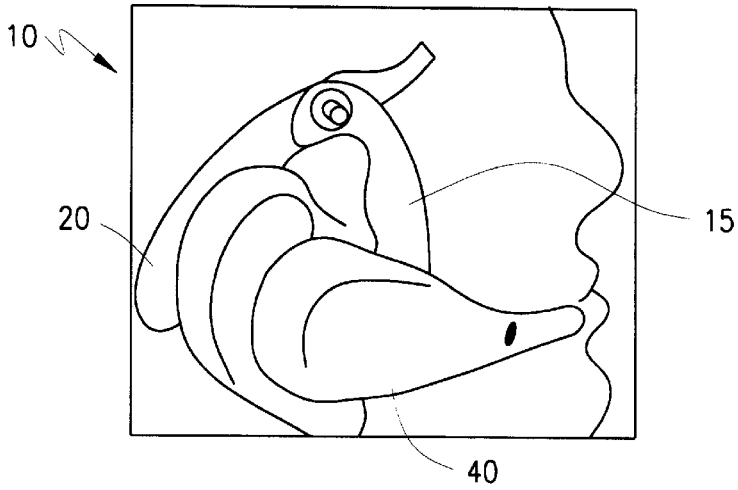
FIG. 4 illustrates the foldable headset hook attaching a headset to the ear of a user.

Referring now to FIG. 4, there is illustrated a headset housing 40 including a foldable hook 10 of the present invention mounted on the ear of a user. As can be seen from FIG. 4, the second member 20 clamps on the back of the ear of a user while the biasing forces of joint 30 maintain the second member 20 in contact with the ear. Likewise, the first member 15 is maintained in a position to support the second member 20 by the biasing forces of joint 25 which is not visible in FIG. 4. In this manner, a microphone and speaker (not shown) within the headset housing 40 may be maintained in close proximity to both the mouth and ear of the user, respectively. While FIG. 4 illustrates the use of a wireless headset including a wireless transceiver 42 for establishing a connection with an associated device such as a mobile telephone, computer, etc., the foldable hook 10 of the present invention may also be used with any type of wireless or wireline headset using, for example, the Bluetooth protocol or any known wireless or wireline protocols.

Figure 5A:
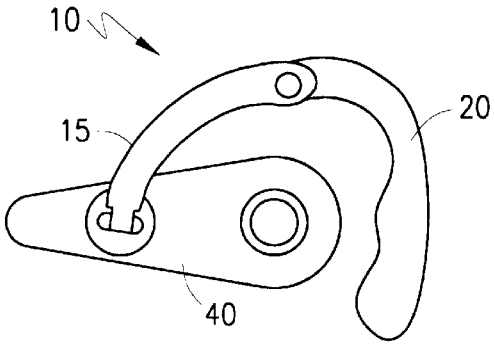
FIGS. 5*a* through 5*c* illustrate the range of movement of the foldable headset hook.
Figure 5B:
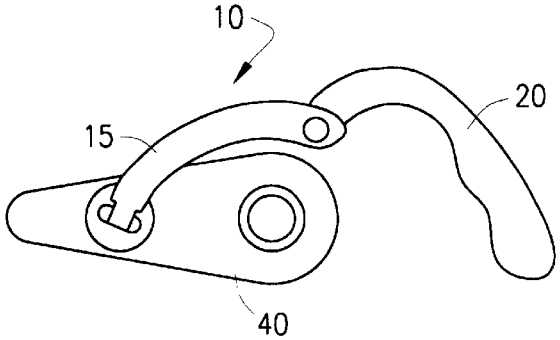
Figure 5C:
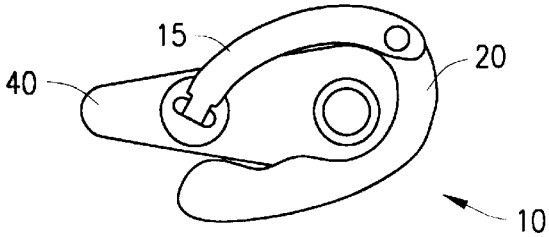

Referring now to FIGS. 5*a* through 5*c* there is illustrated the manner in which the foldable hook 10 moves from an open position about the ear of a user to a closed position wrapped around a housing 40 of a headset. In the open position illustrated, in FIG. 4*a*, the first member 15 is extended away from the housing 40 of the headset and the second member 20 extends to wrap around the ear of a user. FIG. 5*b* illustrates a partially closed configuration wherein the first member 15 has moved to a closed position wrapped around the housing 40 of the headset. The second member 20 remains open. In FIG. 5*c*, the second member 20 has also moved to a closed position wrapped around the housing 40 of the headset. As can be seen, when the first member 15 and second member 20 are in the closed position and wrapped around the housing 40 of the headset, a much smaller package is created for storage.

Utilizing the above described invention, a user may store their headset in a substantially reduced size package enabling the headset to be easily placed within a pocket or purse of the user while greatly decreasing the potential for inadvertently snagging a hook on other items within a pocket, purse or other storage location. The previous description is of a preferred embodiment for implementing the invention, and the scope of the invention should not necessarily be limited by this description. The scope of the present invention is instead defined by the following claims.

What is claimed is:

1. A foldable hook for affixing a headset to an ear of a user, comprising:

a first member having a first and second end, said first end rotatably connected to the headset about a first axis, the rotatable connection is biased to a first position; and a second member for contacting at least a portion of the ear of the user having a first end and a second end, wherein the second member has a substantially arcuate shape for fitting around the ear of the user, said first end of the second member rotatably connected to the second end of the first member about a second axis substantially parallel to the first axis.

2. The foldable hook of claim 1, wherein the rotatable connection between the first end of the second member and the second end of the first member is biased to said first position.

3. The foldable hook of claim 1, further including a third member integral with said second member for a moving said first member and said second member between said first position and a second position.

4. The foldable hook of claim 1, wherein the first and second members are configurable for either a left ear or a right ear of the user.

5. The foldable hook of claim 1, further including a wireless transceiver within the headset for communicating with an associated device.

6. The headset of claim 5, wherein the wireless transceiver operates according to the Bluetooth protocol.

7. The apparatus of claim 5, wherein the second member has a substantially arcuate shape for fitting around the ear of the user.

8. The apparatus of claim 5, wherein the first and second members are configurable for either a left ear or a right ear of the user.

9. The apparatus of claim 8, wherein the first rotatable connection further provides movement of the first member about a second axis enabling configuration for the left ear and the right ear of the user.

10. An apparatus for affixing a headset to an ear of a user, comprising:

a first member having a first end and a second end;

a second member for contacting at least a portion of the ear of the user having a first end and a second end;

a first rotatable connection rotatably interconnecting the first member with the headset about a first axis, said first rotatable connection biased to a closed position;

a second rotatable connection interconnecting the second member with the first member about a second axis substantially parallel to the first axis, said second rotatable connection biased to the closed position; and a third member integral to said second member for rotatably moving said second member about said second rotatable connection and rotatably moving said first member about said first rotatable connection.

11. A headset, comprising:

a housing;

a first member having a first and second end, said first end rotatably connected to the housing about a first axis, wherein the rotatable connection between the first end of the first member and the housing is biased to a first position; and a second member for contacting at least a portion of the ear of the user having a first end and a second end, said first end of the second member rotatably connected to the second end of the first member about a second axis substantially parallel to the first axis, wherein the rotatable connection between the first end of the second member and the second end of the first member is biased to said first position.

12. The headset of claim 11, further including a third member integral with said second member for moving said first member and said second member between a first position and a second position.

13. The headset of claim 11, wherein the second member has a substantially arcuate shape for fitting around the ear of the user.

14. The headset of claim 11, the first and second members are configurable for either a left ear or a right ear of the user.

15. The headset of claim 11, wherein the first rotatable connection further provides movement of the first member about a second axis enabling configuration for the left ear and the right ear of the user.

16. A headset, comprising:

a housing;

a first member having a first end and a second end;

a second member for contacting at least a portion of the ear of the user having a first end and a second end;

a first rotatable connection rotatably interconnecting the first member with the head set about a first axis, said first rotatable connection biased to a first position and further providing movement of the first member about a second axis enabling configuration for the left ear and the right ear of the user;

a second rotatable connection rotatably interconnecting the second member with the first member about a third axis, said second rotatable connection biased to the first position; and a third member integral to said second member for rotatably moving said second member about said second rotatable connection and rotatably moving said first member about said first rotatable connection.

17. The headset of claim 16, further including a wireless transceiver within the housing for communicating with an associated device.

18. The headset of claim 16, wherein the wireless transceiver operates according to the Bluetooth protocol.

* * * * *